US009427084B2

(12) United States Patent
Park et al.

(10) Patent No.: US 9,427,084 B2
(45) Date of Patent: Aug. 30, 2016

(54) RAIL

(75) Inventors: Yoon Sik Park, Seoul (KR); Dong hee Lee, Seoul (KR); Hyun ho Cha, Gyeonggi-do (KR)

(73) Assignees: SEGOS CO., LTD., Incheon (KR); Yoon Sik Park, Seoul (KR)

( * ) Notice: Subject to any disclaimer, the term of this patent is extended or adjusted under 35 U.S.C. 154(b) by 0 days.

(21) Appl. No.: 14/110,740

(22) PCT Filed: Apr. 20, 2012

(86) PCT No.: PCT/KR2012/003054

§ 371 (c)(1),
(2), (4) Date: Oct. 9, 2013

(87) PCT Pub. No.: WO2013/024956

PCT Pub. Date: Feb. 21, 2013

(65) Prior Publication Data

US 2014/0167588 A1 Jun. 19, 2014

(30) Foreign Application Priority Data

Aug. 18, 2011 (KR) ..... 10-2011-0082132
Sep. 9, 2011 (KR) ..... 10-2011-0092165

(51) Int. Cl.
*A47B 88/00* (2006.01)
*A47B 88/14* (2006.01)
*A47B 88/10* (2006.01)

(52) U.S. Cl.
CPC ..... *A47B 88/14* (2013.01); *A47B 88/10* (2013.01); *A47B 2210/0032* (2013.01); *A47B 2210/175* (2013.01)

(58) Field of Classification Search
CPC ..... A47B 88/104; A47B 2210/0056; A47B 2210/0032
USPC ..... 312/334.1, 334.6, 334.7, 334.8, 334.11, 312/334.14, 334.15, 334.16, 334.17, 312/334.25, 334.26, 334.33, 334.36, 312/334.38, 410
See application file for complete search history.

(56) References Cited

U.S. PATENT DOCUMENTS 4,752,142 A * 6/1988 Jackson et al. ..... 384/18
5,570,943 A 11/1996 Schroder et al.

(Continued)

FOREIGN PATENT DOCUMENTS

| | | | | |
|---|---|---|---|---|
| DE | WO 2010112592 | * | 10/2010 | |
| EP | 1350444 | A1 * | 10/2003 | ..... A47B 88/10 |
| JP | 08-502918 | A | 4/1996 | |
| KR | 10-1021574 | B1 | 3/2011 | |
| KR | 10-1024082 | B1 | 3/2011 | |
| WO | WO 2010077027 | A2 * | 7/2010 | ..... A47B 88/10 |

OTHER PUBLICATIONS

Machine Translation, Description WO2010112592, pp. 8-19, retrieved on Apr. 30, 2015.*
Machine Translation KR Pub No. 1020100079712,(Park et al.), originally published Jul. 8, 2010, retrieved from http://kposd.kipo.go.kr:8088/up/kpion/.*
International Search Report for PCT/KR2012/003054.

*Primary Examiner* — Daniel J Troy
*Assistant Examiner* — Kimberley S Wright
(74) *Attorney, Agent, or Firm* — The PL Law Group, PLLC

(57) ABSTRACT

Provided is a rail having a simple structure and capable of stably supporting a load caused by a drawer and accommodated matters. The rail has a structure having a resistance against a torsional load that twists the rail in a central direction of the drawer and configured to prevent interference between components of the rail even when the torsional load occurs.

8 Claims, 5 Drawing Sheets

(56) References Cited

U.S. PATENT DOCUMENTS 5,769,518 A * 6/1998 Grabher ..... 312/334.6
5,775,788 A * 7/1998 Sasse et al. ..... 312/334.38
6,132,020 A * 10/2000 Schael et al. ..... 312/334.1
6,347,849 B1 * 2/2002 Muterthies et al. ..... 312/334.12
6,848,760 B2 * 2/2005 Thomas et al. ..... 312/334.38
2006/0273705 A1 * 12/2006 Yeh ..... 312/334.31
2010/0026154 A1 * 2/2010 Johansson ..... 312/334.9
2011/0241515 A1 10/2011 Park et al.

* cited by examiner

RAIL

CROSS REFERENCE TO RELATED APPLICATIONS AND CLAIM OF PRIORITY

This patent application is a National Phase application under 35 U.S.C. §371 of International Application No. PCT/KR2012/003054, filed 20 Apr. 2012, which claims priority to Korean Patent Application Nos. 10-2011-0082132, filed on 18 Aug. 2011 and 10-2011-0092165, filed on 9 Sep. 2011, entire contents of which are incorporated herein by reference.

TECHNICAL FIELD

The present invention relates to a rail installed at a home appliance or furniture having a drawer accommodating space in which a drawer is accommodated and capable of pulling the drawer therefrom and pushing the drawer thereinto.

BACKGROUND

A home appliance such as a refrigerator or the like, furniture, or the like, has a drawer for convenient accommodation, and the drawer is pulled out of or pushed into a drawer accommodating section via rails disposed in the drawer accommodating section.

That is, the rail is a device installed at an object such as a home appliance, furniture, or the like, having a drawer accommodating section so that a drawer is pulled out of or pushed into the drawer accommodating section.

The rail is configured such that the drawer is pulled out of or pushed into the drawer accommodating section via a fixed rail disposed in the drawer accommodating section provided on the home appliance or furniture and a movable rail installed at the drawer and relatively movable with respect to the fixed rail.

Meanwhile, the rail should be provided to endure a load applied toward a lower portion of the drawer by the weight of the drawer and the weight of matters accommodated in the drawer.

While the load is applied in a longitudinal direction of the entire rail when the drawer is disposed in the drawer accommodating section, the load by the weight of the drawer and the weight of the matters accommodated in the drawer is moved to the outside of the drawer accommodating section along the drawer when the drawer is pulled out of the drawer accommodating section.

Accordingly, the rail should have a structure that can support movement of the load according to the pulling-out and pushing-in of the drawer.

In particular, when the drawer is pulled out of the drawer accommodating section, a torsional load that twists the rail in a direction toward a center of the drawer is increased in the rail. Since the torsional load applied to the rail is closely related to a function of the rail and durability of the rail, the rail should have a structure prepared for the torsional load.

That is, when the torsional load is continuously and periodically generated from the rail, the fixed rail and the movable rail may be interfered with each other to make it difficult to pull or push the drawer, or the movable rail and the fixed rail may be deformed to increase a gap between the fixed rail and the movable rail (increase a gap between the drawer and the drawer accommodating section).

Since these problems may reduce the lifespan of the drawer as well as hinder the function of the drawer, development of the rail configured to stably support the drawer is urgently needed in spite of the torsional load generated by the weight of the drawer and the accommodated matters.

However, even though the conventional rails do not have structures that can effectively overcome the torsional load and various researches on the rail having a strong structure against the torsional load are conducted, a rail that can solve the problems due to the torsional load is not developed yet.

SUMMARY OF INVENTION

In order to solve the problems, an object of the present invention is to provide a rail having a simple structure and capable of stably supporting a load.

Another object of the present invention is to provide a rail capable of effectively overcoming a torsional load.

Still another object of the present invention is to provide a rail capable of preventing interference between components of the rail due to a torsional load.

In order to achieve the aforementioned objects, the present invention provides a rail installed at an object having a drawer accommodating section in which a drawer is accommodated and configured to pull or push the drawer out of or into the drawer accommodating section, the rail including: a movable rail having an accommodating space formed therein, configured to bring the accommodating space in communication with the outside through an open surface, and fixed to a lower surface of the drawer; a rolling body disposed in the accommodating space and installed at both corners opposite to each other in a diagonal direction of the movable rail; and a fixed rail including a fixing section fixed to the drawer accommodating section, a ball support section disposed in the accommodating space and configured to support the rolling body, and a connecting section having one end connected to the ball support section and the other end pulled out of the accommodating space through the open surface and connected to the fixing section, wherein the connecting section is configured to have an angle within a range from 50 to 70 degrees with respect to the fixing section to prevent interference between the open surface and the connecting section even when the movable rail is pressed by the drawer.

In this case, the rolling body may be constituted by two rows of balls disposed at both corners opposite to each other in a diagonal direction of the movable rail. Here, the number of balls installed at each of the ball rows may be varied according to an accommodating volume of the drawer and a width of the drawer.

In addition, the rolling bodies installed at both corners opposite to each other in the diagonal direction of the movable rail may be configured such that a line connecting centers of the rolling bodies has an angle within a range from 40 to 50 degrees with respect to a lower surface of the drawer.

Further, the fixed rail may be formed by bending one plate member such that the ball support section, the connecting section, and the fixing section are integrally formed.

Furthermore, the ball support section may further include: a first ball seating surface extending from the connecting section and in which the rolling body, which is disposed at a lower side, of the rolling bodies installed at both corners opposite to each other in the diagonal direction of the movable rail is accommodated; a second ball seating surface in which the rolling body, which is disposed at an upper side, of the rolling bodies installed at both corners opposite to each other in the diagonal direction of the movable rail is accommodated; a bending surface configured to connect the first ball seating surface and the second ball seating surface; and a seating surface supporter having an extension section extending from the second ball seating surface and a bending section formed by bending the extension section and in contact with an upper portion of the connecting section, wherein the first ball seating surface, the bending surface, the second ball seating surface, and the seating surface supporter are configured such that a cross-sectional shape of the ball support section forms a closed curve, and the first ball seating surface and the second ball seating surface are spaced a predetermined distance apart from each other by the extension section.

In this case, the extension section may have an angle within a range from 35 to 55 degrees with respect to the lower surface of the drawer.

In addition, the ball support section may further include a boundary surface disposed between the connecting section and the first ball seating surface to be located at a position at which the lower rolling body is interfered with an imaginary line extending from the connecting section, and formed by bending the first ball seating surface in a direction of the second ball seating surface.

Further, the bending section may be in contact with the connecting section and disposed on the boundary surface.

Furthermore, the bending section and the connecting section may be adhered to each other at a partial section of a contact section between the bending section and the connecting section formed in the longitudinal direction of the fixed rail to fix the bending section to the connecting section.

Meanwhile, the movable rails may be installed at both opposite ends of the lower surface of the drawer such that the open surfaces are directed toward corners between the side surfaces and the bottom surface of the drawer accommodating section, the fixed rails may be configured such that the fixing sections are fixed to both opposite ends of the drawer accommodating section, and the rolling bodies installed at both corners opposite to each other in a diagonal direction of the movable rails may be configured such that a line connecting centers of the rolling bodies has an angle within a range from 40 to 50 degrees with respect to the lower surface of the drawer.

According to the embodiment of the present invention, it is possible to provide a rail having a simple structure and capable of stably supporting a load.

In addition, according to the embodiment of the present invention, it is possible to provide a rail capable of effectively overcoming a torsional load.

Further, according to the embodiment of the present invention, it is possible to provide a rail capable of preventing interference between components of a rail due to a torsional load.

DESCRIPTION OF EMBODIMENTS

Figure 1:
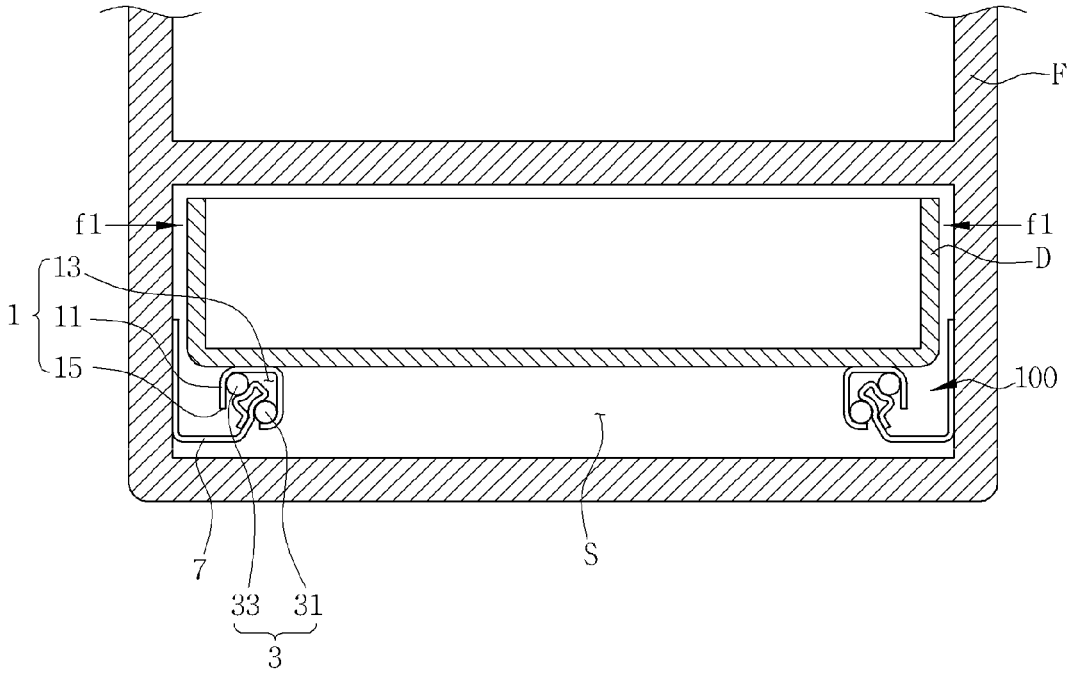
FIG. 1 is a cross-sectional view of a rail according to an embodiment of the present invention coupled to a drawer.

Hereinafter, an embodiment of the present invention will be described in detail with reference to the accompanying drawings.

All terms used herein are equal to the general meaning of terms that can be understood by those skilled in the art unless the context clearly indicates otherwise, and if the terms used herein collide with the general meaning of the terms, the terms will be used as definition used herein.

Meanwhile, a configuration or a control method of an apparatus, which will be described below, is provided not to limit the scope of the present invention but provided to describe an embodiment of the present invention. Like reference numerals designate like elements throughout the description.

A rail 100 according to an embodiment of the present invention is installed at an object F such as furniture, a home appliance, or the like, having a drawer accommodating section S in which a drawer D is accommodated. The rail 100 includes a movable rail 1 coupled to a lower surface of the drawer D, a fixed rail 7 having one end fixed to a bottom surface or a side surface of the drawer accommodating section S and the other end disposed in the movable rail 1, and a rolling body 3 disposed in the movable rail 1 and supported by the fixed rail 7 to enable movement of the movable rail 1.

Figure 2:
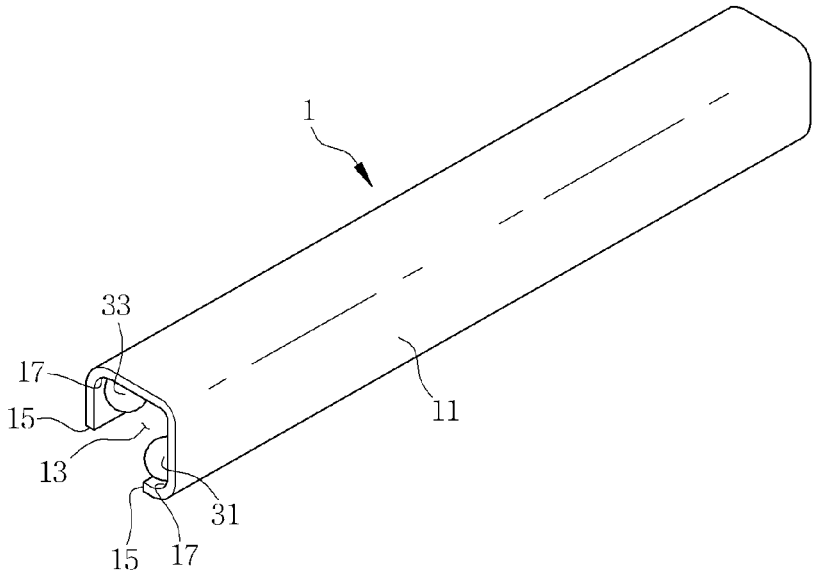
FIG. 2 is a perspective view of a movable rail shown in FIG. 1.

As shown in FIG. 2, the movable rail 1 includes a frame 11 fixed to a lower surface of the drawer D and having at least one open end of both opposite ends (front and rear surfaces in the drawing).

An accommodating space 13 in which the rolling body 3 and a ball support section 73 (to be described below) of the fixed rail 7 are accommodated is installed in the frame 11, and the accommodating space 13 is configured to be in communication with the outside of the frame 11 through an open surface 15.

Meanwhile, the movable rail 1 may further include sliding surfaces 17 installed in a longitudinal direction thereof and disposed at an inner circumferential surface of the accommodating space 13 to support the rolling body 3, and the sliding surfaces 17 may be installed at both corners opposite to each other in a diagonal direction of the frame 11, respectively.

The rolling body 3 includes a lower rolling body 31 disposed at a lower portion of the accommodating space 13 and an upper rolling body 33 disposed at an upper portion in the diagonal direction of the lower rolling body 31, and the plurality of rolling bodies 31 and 33 may be installed in the longitudinal direction of the frame 11.

Figure 4:
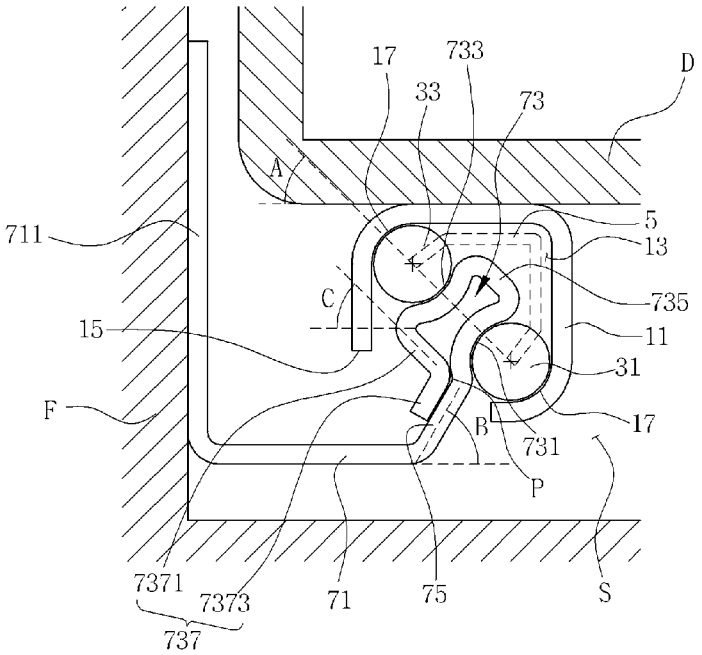
FIGS. 4 and 5 are views for describing methods of installing a fixed rail provided in the rail according to the embodiment of the present invention.

A straight line passing through the lower rolling body 31 and the upper rolling body 33 may be inclined with respect to a lower surface of the drawer D by a predetermined angle (see reference character A of FIG. 4). Accordingly, when a torsional load (see reference character f2 of FIG. 6) is applied to the rail 100 due to the weight of the drawer D and the weight of the accommodated matters, a resistance force of the rail 100 is increased.

Figure 7:
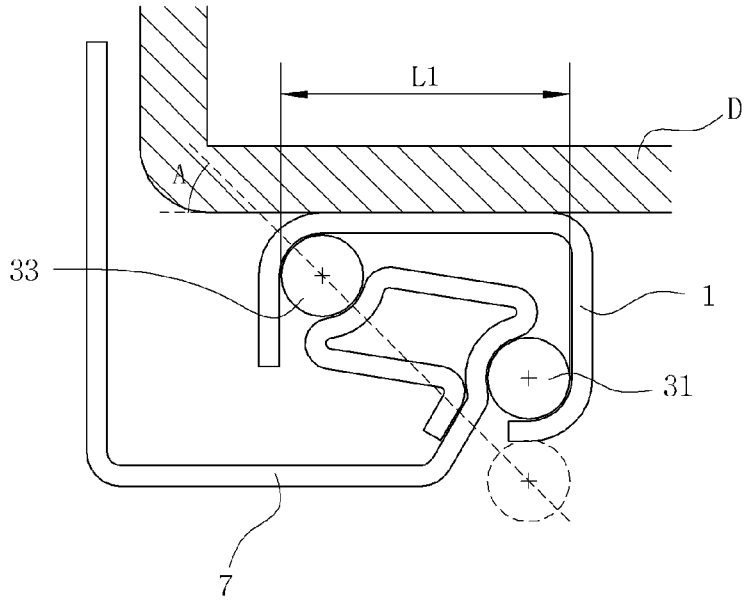
FIGS. 7 and 8 are views for describing a shape of a frame according to an angle formed by a straight line passing through a center of a rolling body installed at the rail according to the embodiment of the present invention and a bottom surface of the drawer.
Figure 8:
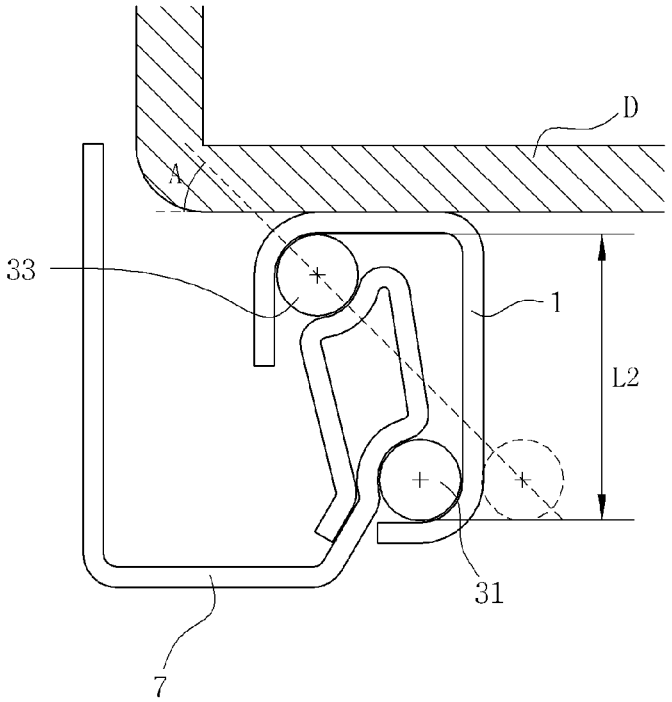

Meanwhile, when a line connecting centers of the rolling bodies 31 and 33 has a certain angle, in particular, 40 degrees or less, with respect to a bottom surface of the drawer D, since a gap between the upper rolling body 33 and the lower rolling body 31 should be increased in a direction parallel to the bottom surface of the drawer D, a length of an upper surface of the frame 11 (see reference character L1 of FIG. 7) may be increased to be vulnerable to the torsional load.

In addition, since the gap between the upper rolling body 33 and the lower rolling body 31 should be increased in a direction perpendicular to the bottom surface of the drawer D when the line connecting the centers of the rolling bodies 31 and 33 is formed to exceed the certain angle, in particular, 50 degrees, with respect to the bottom surface of the drawer D, the frame 11 may be interfered with the fixed rail 7 (to be described below) when a length (see reference character L2 of FIG. 7) of the side surface of the frame 11 is increased and the vertical load, the torsional load, or the side surface external force is applied to the frame 11.

Accordingly, an angle A formed by the line connecting the centers of the lower rolling body 31 and the upper rolling body 33 and the bottom surface of the drawer D may be set within a range of 40 to 50 degrees, and thus the rail 100 according to the embodiment can have an increased resistance against the vertical load and the torsional load due to the drawer D and the accommodated matters.

Meanwhile, while each of the rolling bodies 31 and 33 shown in FIG. 2 is shown as the rolling body 3 having a ball or a spherical shape, the rolling body installed at the rail 100 according to the embodiment of the present invention may be modified in various shapes different from the shown shape as long as the movable rail 1 is movable by the rolling body.

When the rolling bodies 31 and 33 have a ball shape or a spherical shape, the rolling bodies 31 and 33 may be constituted by a pair of ball arrays (not shown) installed in the longitudinal direction of the movable rail 1 and provided at both corners opposite to each other in a diagonal direction of the movable rail 1. Here, the number of balls provided in each of the ball arrays (not shown) may be varied according to an accommodating volume of the drawer D and a width of the drawer D.

In addition, when each of the rolling bodies 31 and 33 is provided in plural, the rail 100 according to the embodiment of the present invention may further include a ball retainer (see reference numeral 5 of FIGS. 4 and 5) disposed in the accommodating space 13 and in which each of the rolling bodies 31 and 33 is accommodated.

The ball retainer 5 is configured to maintain a gap between the rolling bodies 31 and 33 in the accommodating space 13 while rotatably supporting the rolling bodies 31 and 33. While the ball retainer 5 may include a retainer frame (not shown) disposed in the accommodating space 13 and an accommodating groove (not shown) provided in the retainer frame (not shown) to accommodate the rolling bodies 31 and 33, the ball retainer 5 may be modified in various types that can implement the above-mentioned functions.

Figure 3:
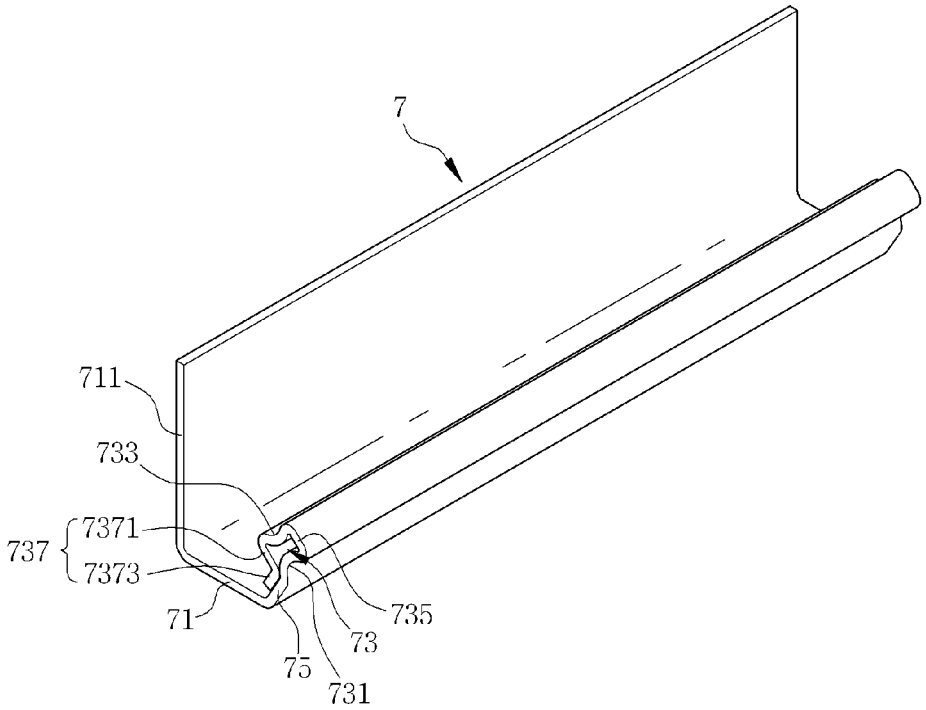
FIG. 3 is a perspective view of a fixed rail shown in FIG. 1.

As shown in FIG. 3, the fixed rail 7 includes a fixing section 71 fixed to the drawer accommodating section S, the ball support section 73 disposed in the accommodating space 13 to support the rolling body 3, and a connecting section 75 having one end connected to the ball support section 73 and the other end disposed at the outside of the frame 11 and connected to the fixing section 71 via the open surface 15.

The fixed rail 7 may be configured to include the ball support section 73, the connecting section 75, and the fixing section 71 by folding one plate member.

Figure 5:
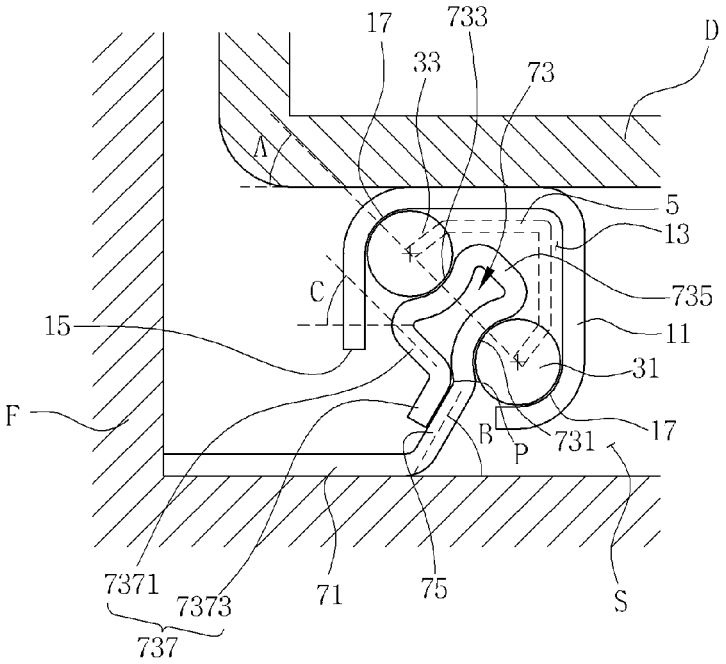

The fixing section 71 may be configured to be fixed to the bottom surface of the drawer accommodating section S as shown in FIG. 5, or may be configured to include a flange 711 configured to fix the fixed rail 7 to a sidewall of the drawer accommodating section S as shown in FIG. 4.

The connecting section 75 is configured to be inclined with respect to the fixing section 71 by a predetermined angle B. Accordingly, even when the vertical load or torsional load (see reference character f2 of FIG. 6) is applied to the rail 100 by the weight of the drawer D and the weight of the accommodated matters, interference between the movable rail 1 and the fixed rail 7 can be prevented. The angle B between the connecting section 75 and the fixing section 71 may be set within a range from 50 to 70 degrees, in particular, 60 degrees.

When the connecting section 75 has an angle larger than 70 degrees with respect to the fixing section 71, since the vertical load and the torsional load are applied to the frame 11, the connecting section 75 and the frame 11 may be interfered with each other to disturb the pulling-out or pushing-in of the drawer D. In addition, when the connecting section 75 has an angle smaller than 50 degrees with respect to the fixing section 71, the frame 11 may come in contact with the bottom surface of the drawer accommodating section S when the vertical load or the torsional load is applied.

In addition, when the connecting section 75 is inclined to have an angle within a range from 50 to 70 degrees with respect to the fixing section 71, a resistance against the side surface external force (or a side surface collision) applied to the side surface of the drawer D may be increased when the drawer D is pulled out.

That is, provided that the drawer D is pulled out of the drawer accommodating section S and a side surface external force f1 as shown in FIG. 1 is applied to the side surface of the drawer D, when the connecting section 75 has an angle smaller than 50 degrees with respect to the fixing section 71, the side surface external force f1 cannot be easily supported, and when the angle is larger than 70 degrees, an interference between the connecting section 75 and the frame 11 by the side surface external force f1 may occur. However, when the connecting section 75 has the inclination angle B within a range from 50 to 70 degrees with respect to the fixing section 71, the side surface external force f1 can be effectively supported to minimize the above-mentioned problems.

The ball support section 73 may include a first ball seating surface 731 extending from the connecting section 75 and configured to accommodate the lower rolling body 31, a second ball seating surface 733 connected to the first ball seating surface 731 through a bending surface 735 and configured to accommodate the upper rolling body 33, and a seating surface supporter 737 extending from the second ball seating surface 733 and configured to come in contact with the connecting section 75.

The second ball seating surface 733 is configured to support the upper rolling body 33 to support most of the vertical load of the drawer D and the accommodated matters, and the first ball seating surface 731 is configured to support the lower rolling body 31 to support the torsional load (see reference character f2 of FIG. 6) applied to the second ball seating surface 733 and the frame 11.

Further, the first ball seating surface 731 and the connecting section 75 may be connected to each other while forming a boundary surface P.

That is, the first ball seating surface 731 may be connected to the connecting section 75 and bent in a direction in which the second ball seating surface 733 is formed such that the lower rolling body 31 is disposed at a position interfered with an imaginary line extending from the connecting section 75.

When the load caused by the drawer D and the accommodated matters is applied to the rail 100, an effect of preventing separation of the lower rolling body 31 between the frame 11 and the ball support section 73 is provided.

Meanwhile, the seating surface supporter 737 includes an extension section 7371 extending from the second ball seating surface 733 in a direction of the connecting section 75 as a means configured to increase a resistance of the rail 100 when the vertical load and the torsional load caused by the drawer D and the accommodated matters are applied to the rail 100, and a bending section 7373 formed by bending one end of the extension section 7371 and configured to come in contact with an upper portion of the connecting section 75.

In this case, the extension section 7371 may be inclined to have a predetermined angle C within a range from 35 to 55 degrees with respect to the bottom surface of the drawer D, and in particular, the extension section 7371 may have an angle of 45 degrees with respect to the bottom surface of the drawer D (an angle of 45 degrees with respect to the bottom surface of the drawer accommodating section S).

Provided that the extension section 7371 is disposed parallel to the bottom surface of the drawer D (an angle of 35 degrees or less) or has an angle of 55 degrees or more, a force applied to the lower rolling body 31 and the upper rolling body 33 cannot be effectively overcome when the vertical load and the torsional load are applied to the rail 100.

Meanwhile, the ball support section 73 may be formed by bending one plate member. In this case, the seating surface supporter 737 may be configured to come in contact with the connecting section 75 to form a closed curve of a cross-sectional shape of the ball support section 73 and configured to form a predetermined space such that the first ball seating surface 731 is spaced a predetermined distance apart from the second ball seating surface 733, and the bending section 7373 of the seating surface supporter 737 may be adhered to a position (the connecting section 75) near the first ball seating surface 731, the boundary surface P of the first ball seating surface 731, and so on.

This is because the load of the drawer D and the accommodated matters transmitted through the rolling bodies 31 and 33 can be effectively supported by the ball support section 73.

That is, when the load (the vertical load and the side surface external force) of the drawer D and the accommodated matters is transmitted to the first ball seating surface 731 and the second ball seating surface 733 through the rolling bodies 31 and 33, since the gap between the first ball seating surface 731 and the second ball seating surface 733 can be maintained as the bending section 7373 of the seating surface supporter 737 is adhered to the connecting section 75 to support the load while the extension section 7371 of the seating surface supporter 737 is compressed, even when the fixed rail 7 has the ball support section 73 formed by bending a thin plate member, the load transmitted from the rolling bodies 31 and 33 can be effectively supported.

In order to maximize the above-mentioned effects, the bending section 7373 of the seating surface supporter 737 may be adhered and fixed to the connecting section 75 to increase adhesion to the connecting section 75 through welding or the like.

However, adhesion and fixing of the bending section 7373 and the connecting section 75 may be performed by continuously or partially fixing the bending section 7373 to the connecting section 75 in the longitudinal direction of the fixed rail 7.

That is, the bending section 7373 and the connecting section 75 may be configured such that the bending section 7373 and the connecting section 75 are adhered to at least a portion of a contact section between the bending section 7373 and the connecting section 75 formed in the longitudinal direction of the fixed rail 7, fixing the bending section 7373 to the connecting section 75.

Figure 6:
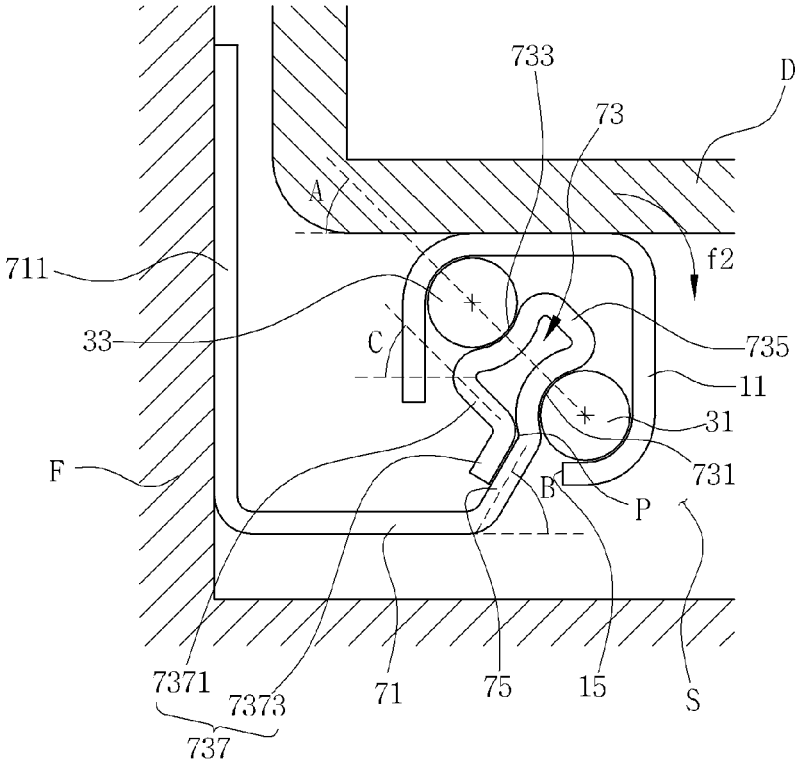
FIG. 6 is a cross-sectional view showing a torsional load applied to the rail according to the embodiment of the present invention.

Hereinafter, functions and effects of the rail 100 according to the embodiment of the present invention having the above-mentioned structure will be described with reference to FIG. 6.

When a user pulls the drawer D out of the drawer accommodating section S in a state in which the drawer D is accommodated in the drawer accommodating section S, the movable rail 1 fixed to the lower surface of the drawer D is moved through guidance of the fixed rail 7, and here, the rolling bodies 31 and 33 are rotated between the movable rail 1 and the fixed rail 7 to assist movement of the movable rail 1.

Meanwhile, when the drawer D is pulled out of the drawer accommodating section S as well as when the drawer D is disposed in the drawer accommodating section S, the torsional load f2 is applied to the rail 100 by the weight of the drawer D and the weight (the load) of the accommodated matters.

Here, since the rolling bodies 31 and 33 disposed in the frame 11 of the movable rail 1 are installed at both corners opposite to each other in the diagonal direction of the frame 11, respectively, and the line connecting the centers of the rolling bodies 31 and 33 has the angle A of 40 to 50 degrees with respect to the lower surface of the drawer D, the torsional load f2 applied in the same direction as shown in the drawing can be effectively offset. That is, since the lower rolling body 31 is disposed closer to the central direction of the drawer D than the upper rolling body 33, the lower rolling body 31 can endure the torsional load.

In addition, since the seating surface supporter 737 is installed at the ball support section 73 of the fixed rail 7 and the extension section 7371 of the seating surface supporter 737 is supported by the connecting section 75 through the bending section 7373, even when the lower rolling body 31 is pressed by the frame 11 due to the torsional load f2, the bending section 7373 supports the load while the extension section 7371 is compressed with adhesion to the connecting section 75. Accordingly, the upper rolling body 33 and the lower rolling body 31 can be securely supported, and deformation and loss of function of the rail 100 due to the torsional load f2 can be prevented.

In addition, in case of the conventional rail (not shown), when the torsional load f2 or the side surface external force f1 is applied to the rail, while the movable rail is interfered with the fixed rail to make it difficult to pull or push the drawer, since the rail 100 according to the embodiment of the present invention is configured such that the connecting section 75 has the angle B of 50 to 70 degrees with respect to the bottom surface of the fixing section 71 or the drawer accommodating section S, the above-mentioned problems can be solved.

That is, since the connecting section 75 installed at the rail 100 according to the embodiment of the present invention is inclined with respect to the fixing section 71 by the predetermined angle B to pass through the open surface 15, connect the fixing section 71 and the ball support section 73, and maintain a certain distance from the open surface 15, even when the frame 11 is moved clockwise by the torsional load f2 or the drawer D is moved to one side by the side surface external force f1, an interference between the frame 11 and the connecting section 75 can be prevented.

While the invention has been shown and described with reference to certain example embodiments thereof, it will be understood by those skilled in the art that various changes in form and details may be made therein without departing from the spirit and scope of the invention as defined by the appended claims.

INDUSTRIAL APPLICABILITY

Since the rail according to the embodiment of the present invention has a simple structure and can stably support the load of the drawer to enable easy manufacture thereof, and an influence due to the torsional load can be minimized to improve durability of the drawer and reduce generation of noises, the rail can be usefully utilized in a drawer manufacturing field.

The invention claimed is:

1. A rail installed at an object having a drawer accommodating section in which a drawer is accommodated and configured to pull or push the drawer out of or into the drawer accommodating section, the rail comprising:

a movable rail having an accommodating space formed therein, configured to bring the accommodating space in communication with the outside through an open surface, and fixed to a lower surface of the drawer;

rolling bodies disposed in the accommodating space and installed at both corners opposite to each other in a diagonal direction of the movable rail, wherein the rolling bodies are composed of only two rows of balls disposed in a longitudinal direction of the movable rail at both corners opposite to each other in a diagonal direction of the movable rail, and the rolling bodies comprises a first rolling body being a first row, which is disposed at a lower side, of said two rows and a second rolling body being a second row, which is disposed at an upper side, of said two rows; and a fixed rail including a fixing section fixed to the drawer accommodating section, a ball support section disposed in the accommodating space and configured to support the rolling bodies, and a connecting section having one end connected to the ball support section and the other end pulled out of the accommodating space through the open surface and connected to the fixing section, wherein the connecting section is configured to have an angle within a range from 50 to 70 degrees with respect to the fixing section to prevent interference between the open surface and the connecting section even when the movable rail is pressed by the drawer; and wherein the ball support section further comprises:

a first ball seating surface extending from the connecting section and in which the first rolling body is accommodated;

a second ball seating surface in which the second rolling body is accommodated;

a bending surface configured to connect the first ball seating surface and the second ball seating surface; and a seating surface supporter having an extension section extending from the second ball seating surface and a bending section formed by bending the extension section and in contact with an upper portion of the connecting section, wherein the first ball seating surface, the bending surface, the second ball seating surface, and the seating surface supporter are configured such that a cross-sectional shape of the ball support section forms a closed curve, and the first ball seating surface and the second ball seating surface are spaced a predetermined distance apart from each other by the extension section.

2. The rail according to claim 1, wherein the extension section has an angle within a range from 35 to 55 degrees with respect to the lower surface of the drawer.

3. The rail according to claim 1, wherein the ball support section further comprises a boundary surface disposed between the connecting section and the first ball seating surface to be located at a position at which the first rolling body is interfered with an imaginary line extending from the connecting section, and formed by bending the first ball seating surface in a direction of the second ball seating surface.

4. The rail according to claim 3, wherein the bending section is in contact with the connecting section and disposed on the boundary surface.

5. The rail according to claim 1, wherein the bending section and the connecting section are adhered to each other at a partial section of a contact section between the bending section and the connecting section formed in the longitudinal direction of the fixed rail to fix the bending section to the connecting section.

6. The rail according to claim 1, wherein the rolling bodies installed at both corners opposite to each other in the diagonal direction of the movable rail are configured such that a line connecting centers of the rolling bodies has an angle within a range from 40 to 50 degrees with respect to a lower surface of the drawer.

7. The rail according to claim 1, wherein the fixed rail is formed by bending one plate member such that the ball support section, the connecting section, and the fixing section are integrally formed.

8. The rail according to claim 1, wherein the movable rail comprise a pair of movable rails installed at both opposite ends of the lower surface of the drawer such that the open surfaces are directed toward corners between the side surfaces and the bottom surface of the drawer accommodating section, the fixed rail comprises a pair of fixed rails are configured such that the fixing sections are fixed to both opposite ends of the drawer accommodating section, and the rolling bodies installed at both corners opposite to each other in a diagonal direction of the movable rails are configured such that a line connecting centers of the rolling bodies has an angle within a range from 40 to 50 degrees with respect to the lower surface of the drawer.

* * * * *